US011376635B2

(12) United States Patent
Krishnamoorthy

(10) Patent No.: US 11,376,635 B2
(45) Date of Patent: Jul. 5, 2022

(54) OBJECT SORTING SYSTEM AND A METHOD THEREOF

(71) Applicant: NANOPIX INTEGRATED SOFTWARE SOLUTIONS PRIVATE LIMITED, Karnataka (IN)

(72) Inventor: Sasisekar Krishnamoorthy, Hubli (IN)

(73) Assignee: NANOPIX INTEGRATED SOFTWARE SOLUTIONS PRIVATE LIMITED, Karnataka (IN)

( * ) Notice: Subject to any disclaimer, the term of this patent is extended or adjusted under 35 U.S.C. 154(b) by 38 days.

(21) Appl. No.: 16/591,681

(22) Filed: Oct. 3, 2019

(65) Prior Publication Data

US 2020/0108415 A1 Apr. 9, 2020

(30) Foreign Application Priority Data

Oct. 3, 2018 (IN) ..... 201841037300

(51) Int. Cl.
*B07C 5/342* (2006.01)
*B07C 5/36* (2006.01)

(52) U.S. Cl.
CPC ..... *B07C 5/3422* (2013.01); *B07C 5/3425* (2013.01); *B07C 5/368* (2013.01); *B07C 2501/009* (2013.01); *B07C 2501/0081* (2013.01)

(58) Field of Classification Search
CPC ..... B07C 5/3422; B07C 5/342; B07C 5/3425; B07C 5/366
See application file for complete search history.

(56) References Cited

U.S. PATENT DOCUMENTS

| | | | | |
|---|---|---|---|---|
| 2,988,197 | A * | 6/1961 | Grosz | B07C 5/3425 198/389 |
| 8,360,249 | B1 * | 1/2013 | Currey | B02C 23/16 209/671 |
| 9,681,679 | B2 * | 6/2017 | Minnicucci | A23N 15/025 |
| 2020/0139410 | A1 * | 5/2020 | Paul | B07C 5/02 |

* cited by examiner

*Primary Examiner* — Michael McCullough
*Assistant Examiner* — Jessica L Burkman
(74) *Attorney, Agent, or Firm* — Fish IP Law, LLP

(57) ABSTRACT

An object sorting system is presented which includes a hopper, a feeder, a roller pair, a pair of orientation flaps, an adjustable assembly, a first and second camera boxes and an ejection assembly. Feeder receives the shells from the hopper and feeds them uniformly over the gap between the rollers which guides and provides fixed orientation to the shells passing through them and conveys the shells which are relatively bigger than the gap between the rollers to one side of the pair of rollers towards the first collection chute by inclining the roller assembly in the range of 0 to 15 degrees towards the first collection chute. A pair of orientation flaps is placed parallel and exactly below the pair of rollers to avoid the deflection of shells caused immediately after passing through the roller gaps.

8 Claims, 4 Drawing Sheets

OBJECT SORTING SYSTEM AND A METHOD THEREOF

CROSS-REFERENCE TO RELATED APPLICATIONS

This application claims the benefit and priority of IN 201841037300, filed Oct. 3, 2018. The entire disclosure of the above application is incorporated herein by reference.

FIELD OF THE INVENTION

The present invention generally relates to a sorting system and method for sorting objects of different characteristics. More particularly, it relates to an automatic object sorting system to sort objects which are partially symmetric at least in one plane or their post cut portions.

BACKGROUND

Getting the dry fruits from farm to consumer is not an easy thing, as there are a lot of processes and step by step instructions that needs to be strictly followed to make sure this happens with retention of nutrition & quality. One of the processes in most of the dry fruit segments is cutting/cracking the outer hard shells of the dry fruits to get the whole kernel out safely. In few of the cases, the kernels/part of the kernels get stuck inside the shell even after cutting/cracking operation. If such shells containing kernel or part of kernel are not separated from the other empty shells, the amount of daily and yearly loss becomes huge for the respective processors. So to sort out these shells with kernels from rest of the empty shells becomes a highly laborious, time consuming and expensive task.

Few shell sorters are already available in the market. One of which includes multi-stage vibrating sieves to sort kernels from the shells immediately after the de-shelling operation. But this fails to solve the problem of separating the shells having kernels or part of the kernels from the rest of the empty shells. Another shell sorter includes air blowers or fans to force hit the shells having kernels or part of the kernels stuck inside them on the walls of closed containers to remove the kernels stuck inside the shell followed by the vibrating sieve and air separation. This comes with a drawback of significant broken kernels as an output. Both of the above sorting systems also lacks optical inspection of each individual shell due to which they significantly miss the accuracy to segregate the shells having kernels or part of the kernels from rest of the empty shells.

There are few patent documents in the prior art using similar technology. Patent application no. RU123691U1 titled "calibrator seeds melon" relates to agricultural engineering and can be used for seedbed preparation for seed melons. The calibrator comprises of multiple rollers rotating in the direction of movement of seed to the forward direction. Each roller has a flap covering the portion of the roller surface of which upper part is in contact with the roller surface and bottom forms a gap in relation to the next roller. The flap is adjustable to increase or decrease the distance between the two adjacent rollers. The seed melons are passed through the rollers to achieve the calibration purpose to get best sowing quality seeds.

Another patent application no. U.S. Pat. No. 5,279,427A titled "Rotary feed table for food product and sliver remover" relates to a roller bed for separating fines and slivers from sliced food product. It includes a plurality of rollers placed side by side on parallel roller shafts. Each roller is provided with alternative crown and flat surface structures around their periphery. A motor coupled to the roller shafts rotates the rollers which are synchronized with each other so that in the gaps between adjacent rollers, the crown portions of one roller coincide with the flat portions of adjacent roller. This arrangement moves properly sized product across the roller bed while allowing smaller fines and slivers to fall between the rollers.

Both of the inventions talk only about the size separation and calibration of objects and uses multiple rollers side by side for the same. Also they lack camera/sensor based sorting as per the size or any other characteristics of the object. So there is a need to have a system which sorts shells after de-shelling operation to separate empty shells from shells having kernel or part of the kernel inside them.

SUMMARY

The present invention discloses an object sorting system for sorting objects that are partially symmetric at least in one plane or their post cut portions. In accordance with one embodiment of the present disclosure, the invention is illustrated considering the de-shelled shells of the cashew nut as the object of interest. Accordingly, the system includes at least one feeder for feeding shells, at least one roller pair arrangement, at least one pair of orientation flaps, an adjustable assembly, a first and second camera boxes, an ejection assembly and collection chutes.

Feeder receives the shells to be sorted from the hopper and feeds them to the roller pair assembly. The shells are fed uniformly over the gap between the rollers using a feeder so that the flow of shells at all points over the gap between the rollers is uniform.

The purpose of the roller pair is to guide and provide fixed orientation to the shells received from the feeder through them and to convey the shells which are relatively bigger than the gap between the rollers to one side of the pair of rollers towards the first collection chute. The roller pair assembly is inclined by 0 to 15 degrees towards the first collection chute to allow the shells to convey towards first collection chute. The roller pair assembly further comprises of a pair of orientation flaps placed parallel to each other and exactly below the pair of rollers by maintaining the same or more distance between the orientation flaps as compared to that of the distance between the rollers. The shells may get deflected and lose their orientation immediately after passing through the roller gap due to inertia, air resistance or other buoyancy forces. So a pair of orientation flaps placed exactly below the roller pairs helps to maintain the fixed orientation of the shells which was already achieved by the pair of rollers. An adjustable assembly is provided for adjusting the distance between the two rollers of the roller pair, distance between the two orientation flaps, distance between the roller pair and the pair of orientation flaps and the inclination of rollers towards the first collection chute.

A first and second camera boxes are arranged exactly below the orientation flaps by maintaining the distance between the two camera boxes relatively larger than the distance between the orientation flaps. Illuminating sources are provided with each camera box to illuminate the falling shells. As soon as the oriented shells exit from the gap between the orientation flaps, they are exposed to the cameras from camera boxes placed on either sides. The cameras from the camera boxes are focused towards the lower ends of the orientation flaps to capture the area of interest of each shell as soon as they start exposing themselves to the camera. The grade of each captured shell is decided and sent to the control panel based on the camera analysis. An ejection assembly is located beneath the viewing zone of the cameras from the camera boxes to eject the shells having kernel or part of the kernel stuck inside them based on the signals received from the control panel and get them collected in the second collection chute. The remaining empty shells are collected in the third collection chute.

The present disclosure also discloses a method for sorting shells having different characteristics. The method includes providing at least one feeder for uniformly feeding shells over the gap between the pair of rollers. Receiving the shells by the pair of rollers and guiding and providing them with a fixed orientation while passing through the gap between the rollers and conveying the shells which are relatively bigger than the gap between the rollers to one side of the pair of rollers towards the first collection chute. Inclining the pair of rollers by 0 to 15 degrees for conveying the shells towards the first collection chute. Receiving the shells guided and oriented by the pair of rollers by the pair of orientation flaps which are positioned and configured to avoid the deflection of falling shells caused immediately after passing through the gap between the rollers and to maintain the already achieved fixed orientation of shells by maintaining the distance between the orientation flaps equal to or more than the distance between the rollers.

Capturing the falling oriented shells as soon as they exit the gap between the orientation flaps and expose themselves to the cameras of the first and second camera box which are arranged exactly below the orientation flaps focusing towards the lower ends of the orientation flaps and by maintaining the distance between the two camera boxes relatively larger than the distance between the orientation flaps. Illuminating the falling shells by the illuminating sources provided with each camera box for proper characteristics capture of the shells. Deciding the grade of each falling shell and sending it to the control panel based on the camera analysis considering the kernel or part of the kernel stuck inside the shell. Ejecting the shells having kernel or part of the kernel stuck inside them based on signals received from the control panel by an ejection assembly located beneath the camera box to get them collected in the second collection chute. Collecting the remaining empty falling shells in the third collection chute.

OBJECTS

The main objects of the present invention are listed below:

- The main object of the present invention is to provide an automated shell sorting system for sorting shells having kernel or part of the kernel from the rest of the empty shells.
- It is another object of the present invention to provide a pair of rollers and a pair of orientation flaps to guide and orient the passing shells to achieve the required orientation when falling through the gap between the rollers.
- It is yet another object of the present invention to provide cameras on both sides below the orientation flaps to capture the characteristics of interest of falling oriented shells as soon as they start exposing themselves immediately after exiting from the gap between the orientation flaps.
- It is further object of the present invention to sort the shells by ejecting them into specific collection chutes based on their characteristics.
- It is yet another object of the present invention to eliminate the need of manual separation and to completely automate the shell sorting procedure after de-shelling operation.

BRIEF DESCRIPTION OF THE DRAWINGS

The purpose and application of the invention can best be understood from the description of the various drawings and embodiments provided herewith.

DETAILED DESCRIPTION OF THE INVENTION

The present invention will now be described in detail with reference to the accompanying drawings.

- As used herein, the term 'object' shall refer to any object which is partially symmetric at least in one plane or its post cut portions which is not limited to any agricultural products like de-shelled/cut shells of raw cashew nuts, raw cashew nuts, cashew pieces, almonds, peanuts, pecan nuts, lentils, melon seeds but also includes synthetically and artificially manufactured objects which satisfies the above stated conditions.
- As used herein, the terms "a pair of rollers", "roller pair" and "rollers" carries the same meaning and may be used alternatively within the scope of the invention.
- As used herein, the term "a pair of orientation flaps" and "orientation flaps" carries the same meaning and may be used alternatively within the scope of the invention.
- As used herein, the term "camera box" comprises of at least one camera and the cameras in a camera box can be located at different orientations focusing towards lower ends of orientation flaps on the falling oriented shells.
- As used herein, the term "de-shelled shells", "cut shells" and "shells" carries the same meaning and may be used alternatively within the scope of the invention.

Figure 1:
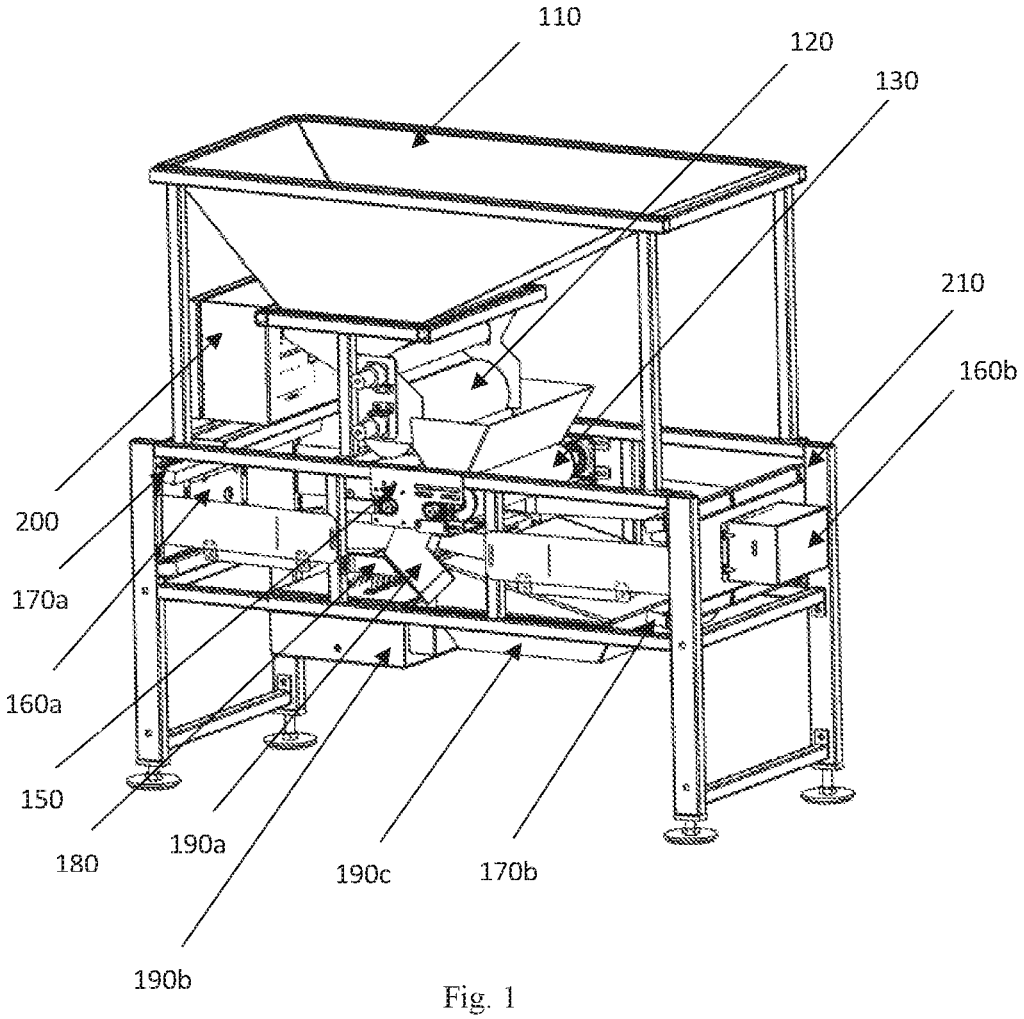
FIG. 1 is a schematic perspective view of the shell sorting system for sorting shells, according to one embodiment of the present disclosure.
Figure 2:
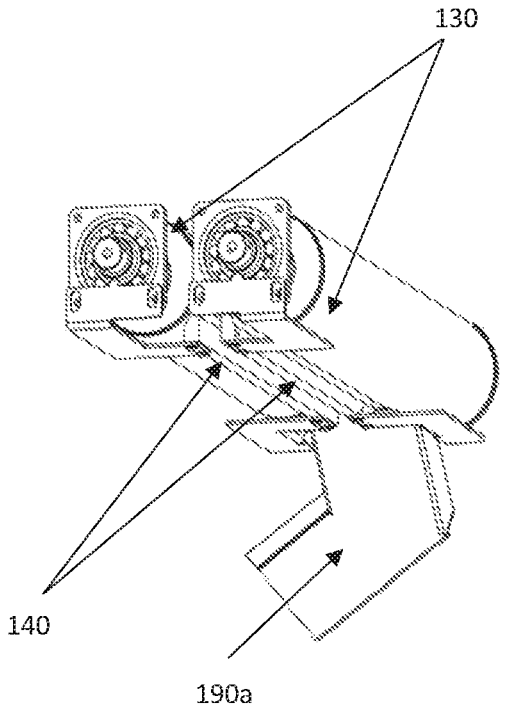
FIG. 2 is a schematic perspective view of a roller pair assembly of system of FIG. 1.

According to one embodiment of the present invention, the proposed invention discloses an object sorting system which sorts objects in different types. FIG. 1 and FIG. 2 shows the schematic diagrams illustrating the non-limiting elements of the invention for sorting objects. The present invention is illustrated considering the de-shelled/cut shells of the cashew nut as the object of interest for the sake of understanding. The same system can also process any object which is partially symmetric at least in one plane or its post cut portions which is not limited to any agricultural products like de-shelled/cut shells of raw cashew nuts, raw cashew nuts, cashew pieces, almonds, peanuts, pecan nuts, lentils, melon seeds but also includes synthetically and artificially manufactured objects which satisfies the above stated conditions. In one of the operations of the cashew nut processing, raw cashew nuts are decorticated. After the decorticating operation the raw cashew nuts gets splitted in different cross sections. These outputs of the raw cashew nut decortication are divided in different types which includes empty shells, half to be scooped or piece to be scooped, full to be scooped or to be scooped, uncut, asymmetric cut and whole kernels or pieces of kernel separated from the shell. The whole kernels or pieces of kernel are separated in the pre-processing itself and remaining decorticated output is inputted directly to the present shell sorting system. So the main criteria for sorting de-shelled shells of the cashew nut is the presence or absence of the kernel or part of the kernel inside the shell. The non-limiting elements of the invention comprises of a hopper (110), a feeder (120), a pair of rollers (130), a pair of orientation flaps (140), adjustable assembly (150), a first camera box (160*a*), a second camera box (160*b*), illuminating sources (170*a* and 170*b*), an ejection assembly (180), collection chutes (190*a*, 190*b* and 190*c*), a control panel (200) and a mainframe (210) for supporting all the above elements.

The shell sorting system comprises of a hopper (110) to introduce the shells in the shell sorting system. The feeder (120) is located below the hopper (110) to receive the shells from hopper (110) and feed the shells further into the gap between the pair of rollers (130) uniformly. A pair of rollers (130) are arranged horizontally below the feeder (120) in such a way that one roller is rotated in reverse to the other and thrusting upwards. The upward thrusting motion of the rollers (130) avoids the crushing or jamming of shells in between the rollers (130). It also helps to maintain the uniform flow of shells through the gap between the rollers (130). The rotating speed of the roller pair (130) is controlled by the control panel (200). The distance between the rollers (130) can also be adjusted by the adjustable assembly (150) based on the size of the shells to be passed through it. In one embodiment of the present invention, the gap between the rollers (130) as well as the gap between the orientation flaps may vary so as to pass the de-shelled shells of variable dimensions at the same time.

A first collection chute (190*a*) is provided at one end of the roller pair (130). The purpose of the roller pair (130) is to guide and provide fixed orientation to the shells received from the feeder through them and also to convey the shells which are relatively bigger than the gap between the rollers (130) to one side of the pair of rollers (130) towards the first collection chute (190*a*).

The roller pair assembly is inclined in the range of 0 degrees to 15 degrees towards the first collection chute (190*a*). The inclination is provided to push the shells which are relatively bigger than the gap between the rollers (130) to one side of the pair of rollers (130) into the first collection chute (190*a*). The inclination of the roller assembly is also adjusted by the adjustable assembly (150). These shells which are directed towards the first collection chute mainly includes uncut and asymmetric cut shells which were sliced or improperly cracked by the decorticator and so their size remains relatively bigger than the other shells. This removal also yields in proper orientation of remaining shells after passing through the roller gap towards the orientation flaps (140) due to restriction of space between the rollers (130) exactly to the size of the shells. In one embodiment of the present invention, when the inclination of the rollers (130) is 0 degrees or they are placed horizontally, then the rollers (130) that are used are threaded/grooved roller pair which will push the shells which are relatively bigger than the gap between the rollers (130) to one side of the pair of rollers (130) towards the first collection chute (190*a*) within predictable amount of time and the remaining shells will pass through the gap between the threaded/grooved rollers. The advantages of using threaded/grooved roller pair is that the conveying speed of shells which are relatively bigger than the gap between the rollers is controlled and conveying time of the shells to reach the first collection chute (190*a*) becomes predictable. The speed of the threaded/grooved rollers too can be controlled using the control panel (200).

In another embodiment of the present invention, a hook is provided along with the cameras/sensors in the vicinity of pair of rollers (130). The purpose of the hook is to dislodge the shell/shells which in case gets stuck in the gap between the rollers (130). Whenever the shell gets stuck anywhere between the gap of the rollers (130) the cameras/sensors immediately senses it and provide the feedback to the control panel (200). Control panel (200) on receiving the feedback, signals the hook provided in the vicinity of the rollers (130) to dislodge the stuck shell/shells and push them in the direction opposite to the first collection chute (190*a*) for collecting in additional collection chute. The application of automated hook ensures uninterrupted working of the system.

A pair of orientation flaps (140) is arranged exactly below the pair of reverse rollers (130) by maintaining a minimum gap between the flap and the roller surface. The pair of rollers (130) are always parallel with the pair of orientation flaps (140) and the distance between the orientation flaps (140) is equal to or more than the distance between the rollers (130). The distance between the orientation flaps (140) will be adjusted simultaneously as per the adjustment in the distance between the roller pair (130) by the adjustable assembly (150). Once the shells are passed through the roller pair (130), they gain orientation for the time being and may again get deflected due to inertia, air resistance or other buoyancy forces. So the purpose and arrangement of the orientation flaps (140) below the roller pair (130) is to maintain the orientation of the shells which was already achieved by the pair of rollers (130).

First and second camera boxes (160*a* and 160*b*) are arranged exactly below the pair of orientation flaps (140) by maintaining the distance between the two camera boxes relatively larger than the distance between the orientation flaps (140). Illuminating sources (170*a* and 170*b*) are provided along with each camera box (160*a* and 160*b*) for proper illumination of shells to be analyzed. The random falling shells get oriented and expose their two essential flat surfaces to the cameras of the camera boxes (160*a* and 160*b*) provided on both the sides opposite to each other. The cameras from both the camera boxes (160*a* and 160*b*) are focused at the lower ends of the orientation flaps (140), where the oriented shells actually start exposing themselves to the cameras. These falling shells uses orientation flaps (140) to achieve required orientation and expose themselves to the cameras from first and second camera boxes (160*a* and 160*b*) placed below the orientation flaps (140) for analyzing the presence or absence of the kernel or part of kernel inside them. The focusing of cameras towards the lower ends of the orientation flaps (140) itself enables the capturing and analyzing of the shells characteristics of interest to happen at very early stage and helps to predict the exact grade of each falling shell accurately and efficiently. Focusing the cameras towards the lower ends of the orientation flaps (140) also makes sure that the full advantage of the shells orientation is being taken by capturing all the necessary characteristics of the shell. The cameras in the camera boxes (160*a* and 160*b*) are arranged in different orientations based on the geometry and characteristics of interest of the objects to be analyzed. The grade data along with the position of each shell is sent to the control panel (200).

In one embodiment of the present invention, the cameras in the camera box can be advanced programmable cameras which can be "synchronous", "asynchronous", "regular", "color", "multi-spectral" cameras, advanced X-ray cameras, advanced spectrometer or combination thereof based on the requirement of the objects to be processed.

Figure 3:
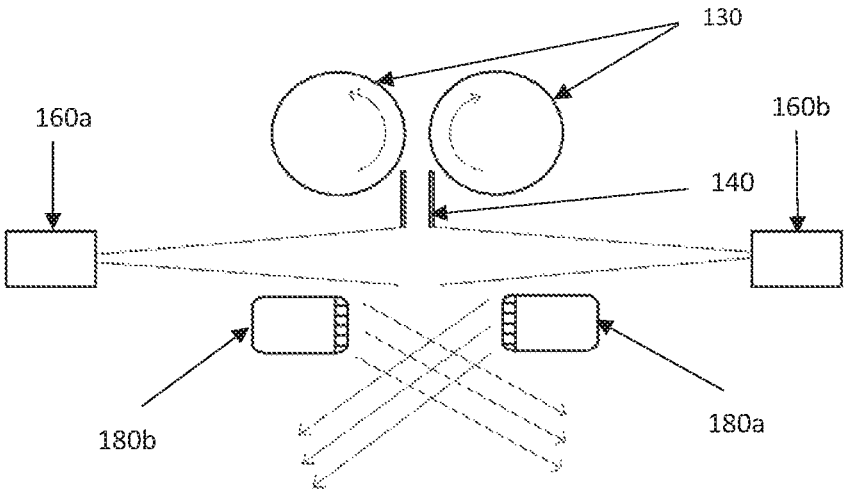
FIG. 3 is a schematic view of one of the embodiments of the shell sorting system depicting the ejection assemblies placed opposite to each other.

The system further comprises of an ejection assembly (180) with multiple ejection nozzles placed exactly below the viewing zone of the cameras from the camera boxes (160*a* and 160*b*) to eject the shells having kernel or part of the kernel inside them. Based on the inputs received from the control panel (200), ejection assembly (180) ejects the shells in respective collection chutes (190*b* and 190*c*). In one embodiment of the present invention, as shown in FIG. 3, there can be two ejection assemblies (180*a* and 180*b*) placed opposite to one another below the viewing zone of the cameras from the camera boxes (160*a* and 160*b*), each with multiple nozzles directing towards different directions for ejecting falling de-shelled shells of different characteristics. So the total number of collection chutes will increase to four with an effect of added ejection assembly.

Figure 4:
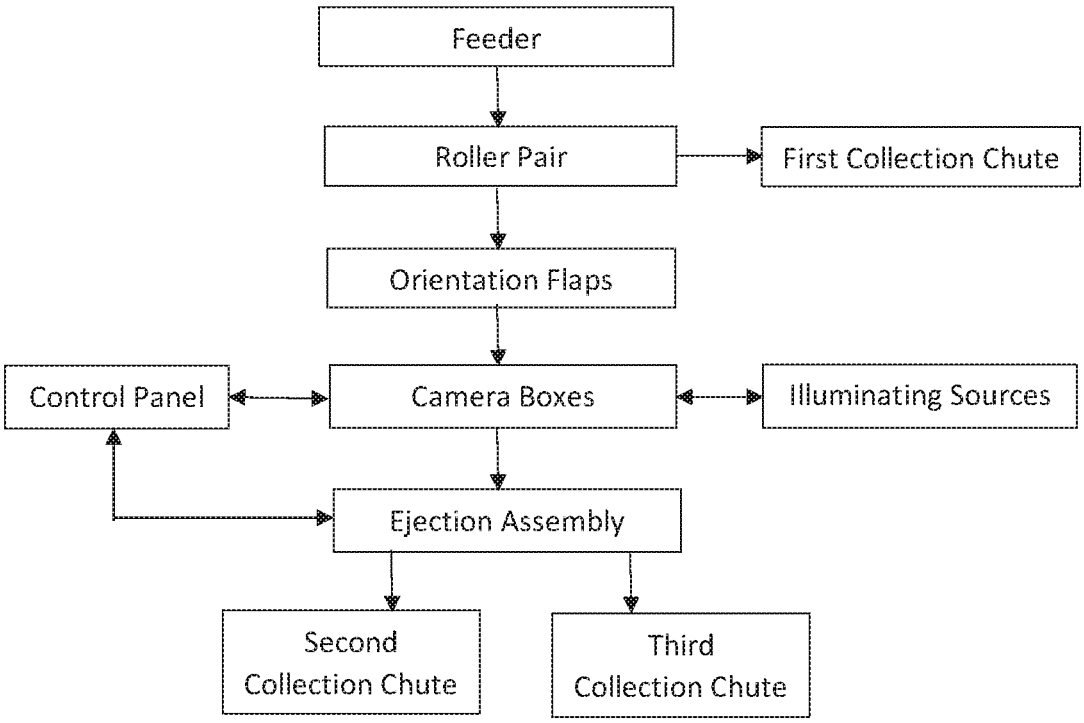
FIG. 4 is a flowchart illustrating the method of working of the invention.

The present disclosure also discloses a method for sorting shells after de-shelling operation based on different characteristics as illustrated in flowchart of FIG. 4. The method includes a feeder (120) to feed the shells uniformly into the gap between the pair of rollers (130). The roller pair (130) receives the shells of different characteristics and passes them through the gap between the rollers (130). The roller pair (130) assembly is inclined between 0 to 15 degrees towards the first collection chute (190*a*) to convey the shells which are relatively bigger than the gap between the rollers (130) towards the first collection chute (190*a*). An adjustable assembly (150) adjusts the distance between the rollers (130), distance between the orientation flaps (140), distance between the roller pair (130) and the pair of orientation flaps (140) and also the inclination of the rollers (130) towards the first collection chute (190*a*). The remaining shells passed through the gap between the roller pair (130) gets oriented to a certain orientation. A pair of orientation flaps (140) are located exactly below the pair of rollers (130) and the distance between the orientation flaps is equal to or more than the distance between the rollers (130) to maintain the orientation of the shells further to the roller pair (130) to avoid the deflections in the orientation of falling shells caused due to inertia, air resistance or other buoyancy forces.

Cameras from the first and second camera boxes (160*a* and 160*b*) which are placed opposite to each other exactly below the pair of orientation flaps (140) by maintaining the distance between the two camera boxes (160*a* and 160*b*) relatively larger than the distance between the orientation flaps (140) are focused towards the lower ends of the orientation flaps (140). The oriented shells are exposed to the cameras as soon as they exit from the gap between the orientation flaps (140). Illuminating sources (170*a* and 170*b*) provided with each camera box, illuminates the shells for their proper inspection. Cameras from the camera boxes (160*a* and 160*b*) analyses the presence or absence of the kernel or part of the kernel inside the falling exposed shell at very early stage near the lower ends of the orientation flaps (140) taking the full advantage of the orientation of the shells. Based on the camera analysis, the grades of the shells are decided and are sent to the control panel (200). Control panel (200) signals the same to the ejection assembly (180) which then ejects the shells having kernel or part of the kernel into the second collection chute (190*b*). All the remaining empty falling shells are collected in the third collection chute (190*c*).

I claim:

1. An object sorting system for sorting a plurality of objects having different characteristics, the system comprising:

a. a feeder for feeding the plurality of objects, said feeder uniformly feeds the plurality of objects into the system;

b. a roller pair assembly configured to receive said plurality of objects from the said feeder, the said roller pair assembly comprising:

i. two rollers placed parallel to each other and inclined in the range of 0 to 15 degrees towards a first collection chute and thrusting upwards at a speed with the purpose of guiding and providing a particular orientation to a first set of objects, from the plurality of objects, received from the said feeder to the pair of rollers and to convey a second set of objects, from the plurality of objects, which are bigger than a gap between the rollers to one side of the said pair of rollers towards the said first collection chute;

ii. a pair of orientation flaps placed parallel to each other below the said roller pair with the purpose of maintaining the particular orientation of said first set of objects and to avoid deflection of said first set of objects caused immediately after their exit through the gap between the rollers due to inertia, air resistance or other buoyancy forces, wherein the distance between the said orientation flaps is equal to or more than the distance between the said rollers of the roller pair;

iii. an adjustable assembly for adjusting:

the distance between the two rollers of the said roller pair;

distance between the two orientation flaps of the said pair of orientation flaps;

distance between the said roller pair and said pair of orientation flaps; and inclination of the rollers towards said first collection chute;

c. a first and second camera box with plurality of cameras along with illuminating sources, arranged below the said orientation flaps by maintaining the distance between the two camera boxes relatively larger than the distance between the said orientation flaps and said cameras focusing towards the lower ends of the orientation flaps, where surface area of the said first set of objects with the particular orientation is exposed to the cameras placed on either sides to capture the characteristics of interest of said first set of objects;

d. an ejection assembly located below the viewing zone of the cameras of the said camera boxes to eject the first set of objects based on the inputs received from a control panel regarding the grade of the corresponding object and get some of the first set of objects collected in the second collection chute and collecting remaining of said first set of objects in the third collection chute.

2. The said object sorting system as claimed in claim 1, wherein the roller pair is a threaded/grooved roller pair to push the said second set of objects which are bigger than the gap between the rollers to one side of the said threaded/grooved pair of rollers towards the said first collection chute within the predictable amount of time.

3. The said object sorting system as claimed in claim 1, wherein two ejection assemblies are placed opposite to one another below the viewing zone of the cameras from the said camera boxes focusing in different angles to eject and direct the first set of objects of different characteristics in their respective collection chutes.

4. The said object sorting system as claimed in claim 1, wherein each camera box comprising plurality of cameras with different orientations so as to capture all the required characteristics of said first set of objects.

5. A method for sorting a plurality of objects with different characteristics, the method comprising:

a. feeding the plurality of objects by a feeder over a pair of rollers in a way to uniformly spread the said plurality of objects over a gap between the said pair of rollers;

b. inclining the said pair of rollers in the range of 0 to 15 degrees towards a first collection chute and receiving the said plurality of objects by the said pair of rollers and guiding and providing a first set of objects, from the plurality of objects, with a particular orientation while passing through the said roller pair and conveying a second set of objects, from the said plurality of objects, which are relatively bigger than the gap between the rollers to one side of the said pair of rollers and collecting them in the said first collection chute;

c. receiving the said first set of objects guided and oriented by the said pair of rollers by the pair of orientation flaps which are positioned and configured to maintain the already achieved the particular orientation of said first set of objects by avoiding deflection of said first set of objects caused immediately after the passing of said first set of objects from the gap between the said rollers due to inertia, air resistance or other buoyancy forces, by keeping the distance between the said orientation flaps equal to or more than the distance between the rollers of the said roller pair;

d. capturing the characteristics of said first set of objects by said cameras placed in a first and second camera boxes and focusing the said cameras towards the lower ends of the said orientation flaps, wherein surface area of the said first set of objects with the particular orientation is exposed to the cameras along with their illuminating sources which are arranged below the said orientation flaps by maintaining the distance between the two said camera boxes relatively larger than the distance between the said orientation flaps;

e. ejecting the said first set of objects based on the inputs received from a control panel regarding the grade of the corresponding object by an ejection assembly located below the viewing zone of the cameras of the said camera boxes to get some of the first set of objects collected in the second collection chute;

f. collecting the remaining of said first set of objects in the third collection chute.

6. The said object sorting method as claimed in claim 5, wherein the roller pair is a threaded/grooved roller pair to push the said second set of objects which are bigger than the gap between the rollers to one side of the said threaded/grooved pair of rollers towards the said first collection chute within the predictable amount of time.

7. The said object sorting method as claimed in claim 5, wherein two ejection assemblies are placed opposite to one another below the viewing zone of the cameras from the said camera boxes focusing in different angles to eject and direct the first set of objects of different characteristics in their respective collection chutes.

8. The said object sorting method as claimed in claim 5, wherein each camera box comprises of plurality of cameras with different orientations so as to capture all the required characteristics of said first set of objects.

* * * * *